United States Patent [19]

Erwin

[11] Patent Number: 4,796,526

[45] Date of Patent: Jan. 10, 1989

[54] VALUE PRINTING DIE PROTECTION DEVICE IN AN ELECTRONIC POSTAGE METER MACHINE

[75] Inventor: Timothy R. Erwin, Trumbull, Conn.

[73] Assignee: Pitney Bowes Inc., Stamford, Conn.

[21] Appl. No.: 508,356

[22] Filed: Jun. 27, 1983

[51] Int. Cl.[4] ..... B41L 39/04

[52] U.S. Cl. ..... 101/65; 83/DIG. 1; 101/70; 101/233

[58] Field of Search ..... 400/8; 101/335, 52, 101/65, 69, 70, 91,93.11, 287, 233, 235; 83/DIG. 1

[56] References Cited

U.S. PATENT DOCUMENTS

| | | | |
|---|---|---|---|
| 483,511 | 9/1892 | Cook | 101/70 |
| 1,708,966 | 4/1929 | Duncan | 101/52 |
| 2,105,660 | 1/1938 | Kirshner | 101/69 |
| 2,303,793 | 12/1942 | Pearson | 101/91 |
| 2,350,853 | 6/1944 | Wheeler | 101/287 |
| 2,773,446 | 12/1956 | Koebler | 101/233 |
| 3,037,447 | 6/1962 | Gonzalez | 101/235 |
| 3,942,436 | 3/1976 | Lupkas | 101/93.11 |
| 4,325,186 | 4/1982 | Creton | 83/DIG. 1 |

FOREIGN PATENT DOCUMENTS

| | | | |
|---|---|---|---|
| 699802 | 12/1930 | France | 101/65 |

*Primary Examiner*—Clyde L. Coughenour

*Attorney, Agent, or Firm*—Peter Vrahotes; Melvin J. Scolnick; David E. Pitchenik

[57] ABSTRACT

A die protection device that prevents the taking of fraudulent non-metered impressions from the value printing die surface of a printing member in a postage meter machine. A slug is reciprocally received within the print head of the postage meter machine such that the slug will extend beyond the diameter of the print head when the postage meter machine is inoperative, but the slug will be retracted during operation for the purpose of allowing the printing postage on an envelope. The device is particularly useful in a postage meter having a reciprocating platen.

10 Claims, 5 Drawing Sheets

VALUE PRINTING DIE PROTECTION DEVICE IN AN ELECTRONIC POSTAGE METER MACHINE

BACKGROUND OF THE INVENTION

In the field of value printing, as for example in postage meter machines, a constant vigil is maintained to assure that the taking of fraudulent impressions from the value printing die surface of a printing member is prevented. In a reciprocating platen type of postage meter machine, this is of a particular concern since the print head of such machines is not rotated out of exposure as occurs with a rotary type postage meter machine. One scheme for preventing the taking of fraudulent impressions is disclosed in U.S. Pat. No. 2,350,853 wherein a manually operable postage meter machine of the reciprocating type is disclosed. A rocker member with a plunger portion is utilized to prevent fraudulent impression taking. The plunger portion extends within a printing die block and is normally located beyond the perimeter of the printing dies. A handle, or crank, is provided that is manually operable to bring about the printing of postage on an envelope and upon such manual operation, the plunger portion is retracted from the printing die block at the appropriate moment so as to expose the printing dies. Although such a device functions quite well in a mechanical postage meter machine, it obviously would be impractical to adapt it for an electronic postage meter machine because of the automatic functioning of the latter. The problem with preventing fraudulent impression taking involves exposure of a print head so that the same may be "wiped" if the print head is exposed; an envelope or tape may be pressed against the print head to obtain unauthorized postage. In considering schemes for preventing such fraudulent taking of postage, problems arise with postage meter mailing machines because the print head must be exposed during a period of operation and a wrongdoer may stop operation at this particular period and obtain fraudulent impressions if no safeguards are taken.

SUMMARY OF THE INVENTION

A system has been devised wherein a security feature is provided to an electronic postage meter machine of the reciprocating platen type. In such a postage meter machine, a platen is electrically controlled by a microprocessor so as to be driven towards a print head upon an envelope contacting a print switch. In the preferred embodiment of this invention, a slug is reciprocally located in the print head. The slug extends beyond the location of the printing dies when the postage meter machine is at rest so that there is no possibility of the print dies being wiped to obtain fraudulent impressions.

The postage meter machine is initialized by a key switch and upon such initialization the microprocessor will cause the slug to be moved within the print head so that its one end is flush with the print dies to allow the printing of postage. At this point, unauthorized taking of postage is prevented because of the presence of the ink roller assembly located immediately in front of the print head. Upon an envelope being placed into contact with the print switch, the ink roller will pass across the selected print dies of the print head in order to ink the same thereby exposing the print head so that an authorized impression may be made upon the envelope. If the machine is disabled by the switch, the print head will not become exposed because the slug will be immediately driven downwardly, thereby securing the print head from unauthorized impressions. The microprocessor will continue operation of the motor of the postage meter machine until such time as the ink roller is in the home position. In this way, there is no possibility of the meter print head being exposed so that fraudulent impressions may be taken.

DETAILED DESCRIPTION OF THE PREFERRED EMBODIMENT

Figure 1:
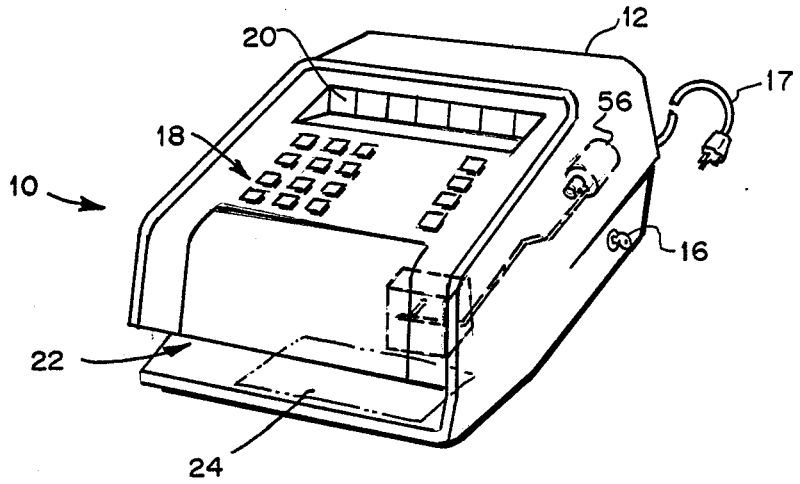
FIG. 1 is a perspective view of a postage meter machine in which the instant invention is utilized.
Figure 2:
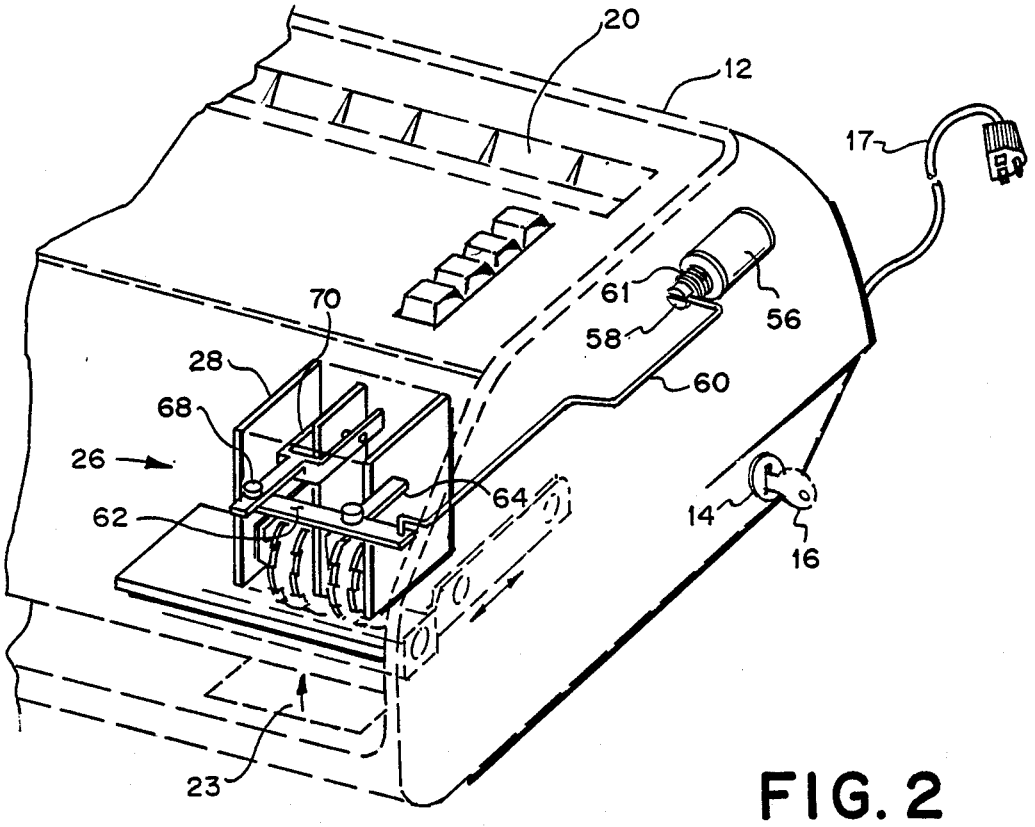
FIG. 2 is a portion of the postage meter machine shown in FIG. 1, again in perspective, showing details of the print station.

Referring now to FIGS. 1 and 2, an electronic postage meter machine of the reciprocating platen type is shown generally at 10 and has a housing 12 that supports the various components of the machine. A key switch 14 is located in the side of the housing 12 and is adapted to receive a key 16 such that the electrical components of the machine 10 may be connected to A.C. power from a line 17. Located at the top of the housing 12 is a keyboard 18 which allows the input of data and a display board 20 which indicates the data that has been supplied through the keyboard. At the lower end of the housing 12 is a slot 22 that has a switch 23 therein. The switch 23 is for the purpose of sensing the presence of an envelope that is inserted into the slot 22. A platen 24 is located at the lower end of the slot 22 for reciprocating vertically therewithin. Positioned above the platen 24 is a print station, shown generally at 26.

Figure 3:
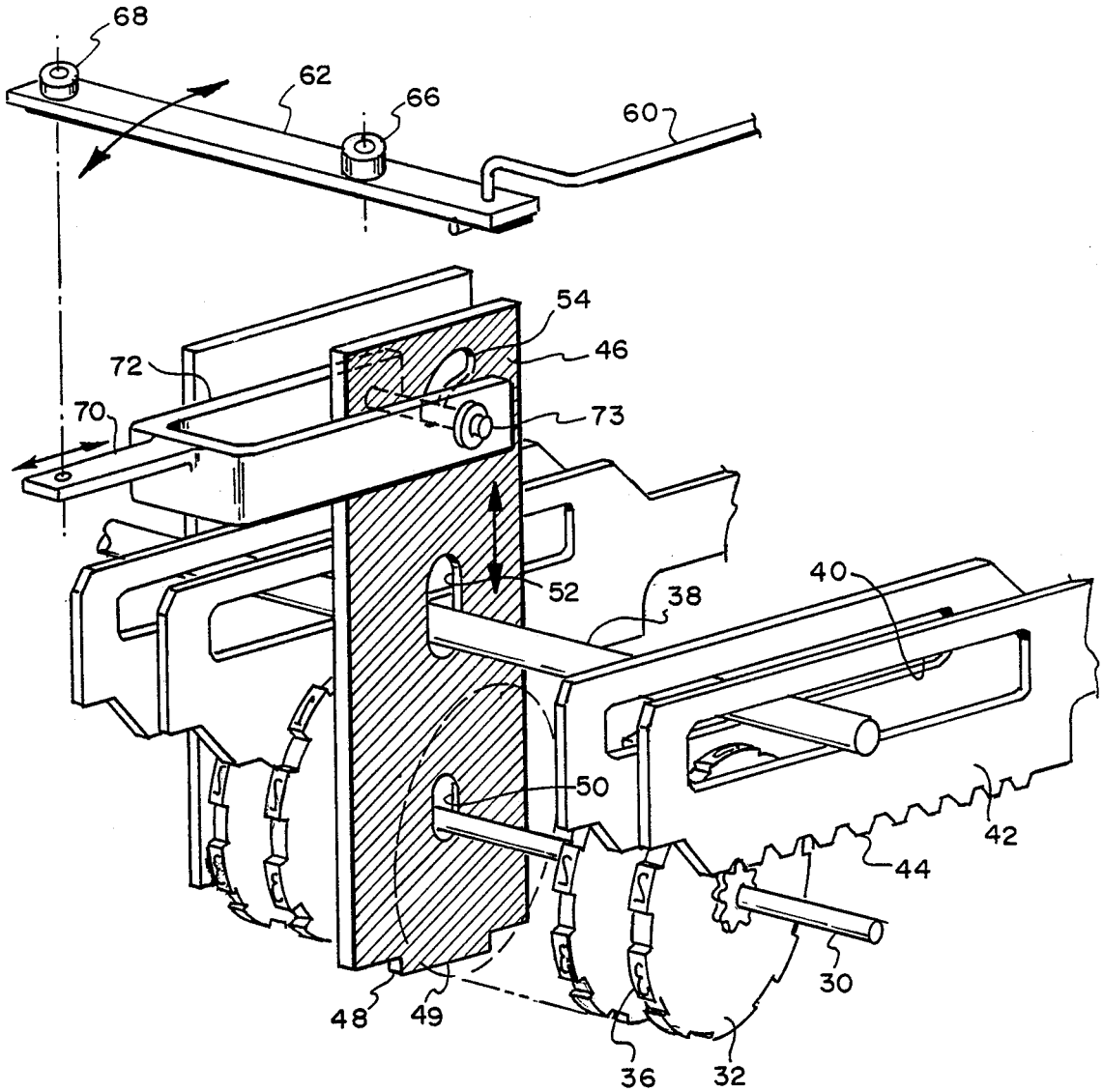
FIG. 3 is a perspective view showing details of the print station shown in FIG. 2.

Referring now to FIGS. 2 and 3, a bracket 28 is supported within the housing 12 and fixedly supports a shaft 30 therein. The shaft 30 has a plurality of print wheels 32, in this case four print wheels, that are rotatably supported thereupon so as to be aligned with an indicia plate 33 (see FIG. 4). Each of the wheels has a gear 34 integral therewith. On the perimeter of each of the print wheels 32 are fonts 36 having a numerical representation of one of the numerals 0–9 on the face thereof. The combination of the bracket 28, shaft 30 and print wheels 32 constitutes a print head as used in this specification. A rod 38 is also supported within the bracket 28 above the position of the shaft 30. This rod 38 is received within longitudinally extending openings 40 of racks 42, there being a rack associated with each of the print wheels 32, that have rack teeth 44 at the lower end thereof that mesh with the gears 34 of the print wheels 32.

Located between the print wheels 32 is a vertically extending, generally rectangular slug 46 that has a projection 48 at the end thereof. The projection 48 may have a decimal point font 49 thereon. The slug 46 has a pair of vertically extending openings 50 and 52 which receive the shaft 30 and rod 38, respectively. The slug 46 also has an arcuate or curvalinear opening 54 at the upper portion thereof.

Supported within the housing 12 is a solenoid 56 whose piston 58 supports a link 60 that extends almost the entire length of the housing 12. Disposed about the solenoid piston 58 is a compression spring 61 between the body of the solenoid 56 and the link 60 which urges the link away from the solenoid. The link 60 is pivotally connected to a lever 62 that is pivotally connected to a rib 64 by a pin 66. The rib 64 is fixed to the bracket 28. Another pin 68 pivotally connects a yoke 70 to the lever 62, the yoke 70 having a pair of arms 72 that receive the slug 46 therebetween. A shaft 73 is supported by the yoke arms 72 and are received within the arcuate opening 54 of the slug 46.

Figure 4:
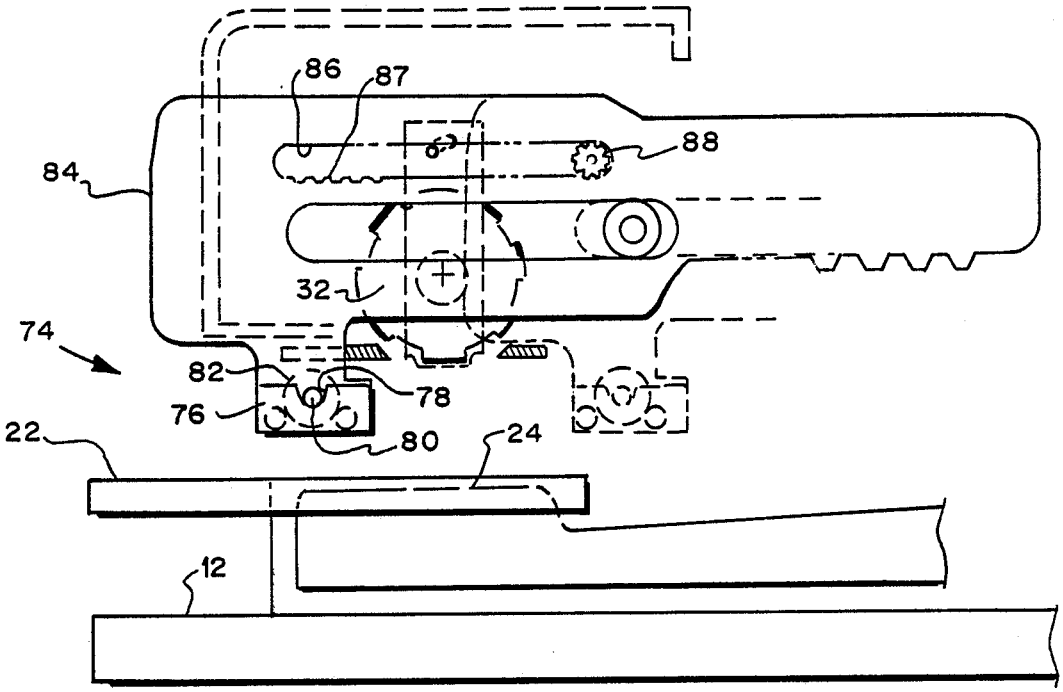
FIG. 4 is a cross-sectional view of a portion of the postage meter machine shown in FIG. 1 with parts removed for purposes of clarity.
Figure 5:
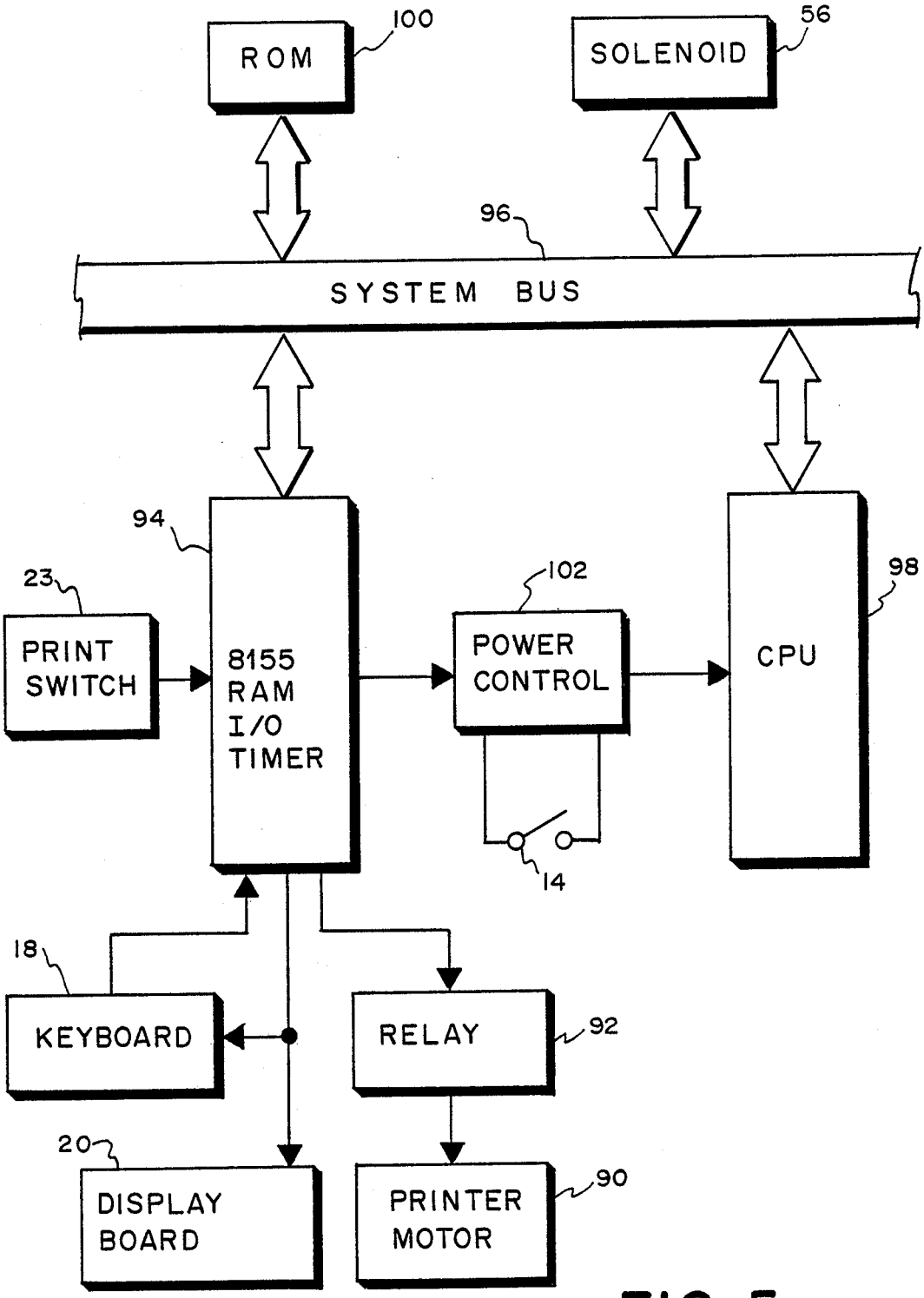
FIG. 5 is a block diagram of the electrical circuitry that controls operation of a postage meter machine constructed in accordance with the instant invention.
Figure 6:
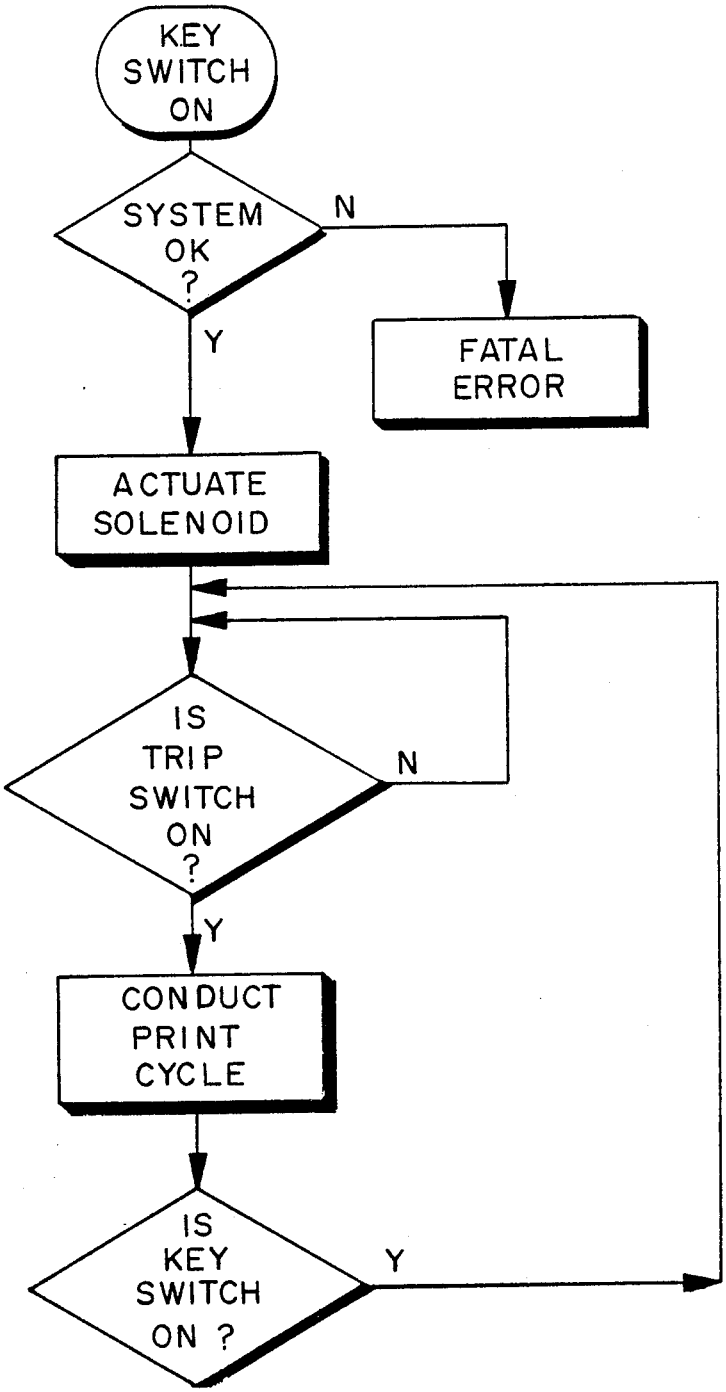
FIG. 6 is a chart of the steps carried out in the operation of the postage meter machine shown in FIG. 1 to prevent the taking of fraudulent impressions.

Referring now to FIGS. 2 and 4, located within the housing 12 adjacent the print wheels 32 is an ink roller assembly 74 which includes an ink roller housing 76. The ink roller housing 76 has a pair of slots 78 on opposite ends thereof that receive shaft ends 80 extending from an ink roller 82 that is rotatably mounted within the roller housing 76. A bracket 84 supports the ink roller housing 76. The bracket 84 has an opening 86 with teeth 87 therein. A gear 88 is received within the opening 86 and meshes with the teeth 87. A motor 90 is supported within the housing 12 and is in engagement with the gear 88 to provide linear drive to the bracket 84 and with the platen 24 to provide reciprocal motion thereto.

Referring now to FIG. 4, a block diagram is shown of the electrical system of the meter 10. The motor 90 is connected through a relay 92 to an integrated circuit 94 which has a RAM with accounting circuitry to account for printed postage, input and output lines and a timer. The integrated circuit 94 may be an Intel model 8155. Connected also to the integrated circuit 94 is the keyboard 18, the display board 20 and the slot switch 23. The integrated circuit 94 is in connection with a system bus 96 through which electrical connection is had with various components in the electrical system including the solenoid 56. A microprocessor or central processing unit (CPU) 98 is provided for controlling the operations of the postage meter machine 10 and the CPU is in contact with the other components of the electrical system through the system bus 96. The CPU 98 may be an 8-bit microprocessor such as an Intel model 8085A. A ROM 100 is in connection with the system bus, the ROM 100 containing the operating instructions for the system. A power control unit 102 is located intermediate the integrated circuit 94 and the CPU 98 and is an electrical connection with the key switch 14 so as to provide power to the system.

In operation, the slug 46 will be initially, i.e. before power is supplied to the postage meter machine 10, in its home position so that the projection 48 extends beyond the print wheels 32 to be located intermediate the print wheels and the platen 24. At the outset, the ink roller assembly 74 will be located immediately in front of the print station 26 and the platen 24 will be at it's lower most position. In this state, the piston 58 of the solenoid 56 will be fully extended because of the effect of the spring 61 so that the lever 62 is pivoted about the pin 66 so as to push the yoke 70 toward the slug 46. In such position, the shaft 73 is in contact with the upper portion of the curvalinear opening 54, the right hand side of the opening as seen in FIG. 3. This is the status the components of interest will assume when no power is supplied to the postage meter machine 10 and the slug 46 is thereby in a location such that the print wheels and print die cannot be wiped to obtain an unauthorized impression. In order to print postage upon an envelope, the key 16 would be inserted and turned in the key switch 14 and power would be supplied to the postage meter machine 10. With such power supplied, the CPU 98 will check to make sure the inker assembly 74 is located in front of the print wheel station 66. If not, the motor will be started to drive the inking assembly to its home position. The solenoid 56 then would be actuated and the piston 58 drawn inwardly so as to overcome the spring 61 thereby rotating the lever 62 about the pin 66 to cause the yoke 70 to be moved in a direction away from the slug 46. With this occurrence, the shaft 73 will move across the upper surface of the curvalinear opening 54, from right to left as seen in FIG. 3, towards the lower portion. Because the slug 46 is retained by the shaft 30, received in opening 50, and the rod 38, received in opening 52, it is able to move vertically only. Since the left side of the curvalinear opening 54 is the lowest location, the slug 46 will be lifted and the projection 48 would be placed substantially in alignment with the lower part of the print wheels 32 so that the decimal point font 49 is aligned with the numerical fonts 36 to form a part of the selected postage. In this status, the ink roller assembly 74 is located in front of the print wheels 32 to prevent the fraudulent taking of impressions.

The postage to be printed will be input through the keyboard 18 and the racks 84 will cause the print wheels 32 to be rotated accordingly. In this way, the selected fonts 36 that represent the postage to be printed will address the platen 24. When an envelope is inserted in the slot 22 it will contact the switch 23 which will then send a signal to the CPU 98. The CPU 98 will cause the print motor 90 to be activated thereby causing the ink roller 82 to move across the print wheels 32 to ink the lower most or selected fonts 36. After the ink roller 82 clears the print wheels 32, it will be located within the housing 12 at a location as indicated by the dotted representation in FIG. 4. The platen 24 will rise to impress the inserted envelope upon the print wheels 32 thereby imprinting the postage and indicia upon the envelope. Because of the movement of the various components, a fraudulent taking of valve cannot be taken during a print cycle.

The ROM 100 is programmed in such a way that when the ink roller 83 is displaced from the print wheels and located within the housing 12, if the key 16 is rotated to turn off the switch 14, the CPU 98 will cause the solenoid to rotate the lever 62 so as to lower the slug 46 and protect the print head 26 from fraudulent impressions. The slug 46 is lowered immediately upon opening of the key switch 16. The ink roller is able to move across the print station 26 to its home position when the slug 46 is in its lowermost position.

An alternative method of operation would be to have the slug 46 remain in its home position after the switch 14 is actuated and to have the solenoid 56 actuated when the switch 23 senses an envelope. The slug 46 is removed to the print position only after the machine begins to cycle and is returned to the blocking position prior to the end of a cycle. In this way, the print station is not exposed except during the print cycle.

What is claimed is:

1. An obstruction mechanism for preventing fraudulent impressions being obtained from the print wheels of a reciprocating type of postage meter machine that has postage information inputting means, print wheels that are settable in accordance with the input information, a reciprocating platen operative to be moved into contact with the print wheels, a motor for reciprocally driving the platen, a power switch for providing electrical power to the machine, a switch for sensing the presence of a document to be imprinted upon the platen and enabling the motor for driving the platen into contact with the print wheels upon actuation of the print switch, comprising: a slug received within the print wheels and extending intermediate the print wheels and the platen when in its home position, means for moving said slug away from the home position to a non-obstructing position upon the power switch being enabled, said platen being driven into printing contact with said print wheels upon said sensing switch sensing an envelope and a means for returning the slug to its home position upon the power switch being disabled.

2. The obstruction mechanism of claim 1 including solenoid means located with electronic meter machine, said solenoid means being connected to the slug and in electrical connection with the power switch, whereby upon the power switch being actuated said solenoid means will cause said slug to be moved from said home position to said non-obstructing position and upon said power switch being turned off said solenoid means will cause said lug to return to said home position.

3. The obstruction mechanism of claim 2 wherein said moving means includes a lever pivotably mounted in the machine, a link connected at one end to said lever and at its other end to said solenoid means, a connection means between said lever and said slug whereby upon said solenoid means being actuated said lever will be pivoted to cause said slug to be moved.

4. An obstruction mechanism for preventing fraudulent impressions from being obtained from the print wheels of a reciprocating type of postage meter machine that has postage information inputting means, print wheels that are settable in accordance with the input information, a reciprocating platen operative to be moved into contact with fonts of the print wheels selected through the inputting means, a switch for providing power to the machine, and enabling means for driving the platen into contact with the print wheels, comprising: a slug received within the print wheels and extending intermediate the print wheels and the platen when in its home position, means for moving said slug away from the home position to a non-obstructing position upon the switch being enabled and a means for returning the slug to its home position upon the switch being disabled.

5. The obstruction mechanism of claim 4 including solenoid means located within the machine and means connected to the slug and the solenoid means for moving the slug upon the solenoid being actuated.

6. The obstruction mechanism of claim 5 wherein said moving means includes a lever pivotably mounted in said machine, a link connected at one end to said lever and at its other end to said solenoid means, a pivotal connection means between said lever and said slug whereby upon said solenoid means being actuated said lever will be pivoted to cause said slug to be moved.

7. The obstruction mechanism of claim 6 wherein said slug has a deceived font thereon that is in alignment with the selected fonts of the print wheels when said slug is in its non-obstructing position.

8. An obstruction mechanism for preventing fraudulent impressions from being obtained from the print wheels of a reciprocating type of electronic postage meter machine that has postage information inputting means, print wheels that are settable in accordance with the input information, a reciprocally movable platen operative to be moved into contact with the print wheels, a print switch for sensing the presence upon the platen of a document to be imprinted and enabling means for driving the platen into contact with the print wheels upon actuation of the print switch, comprising: a reciprocally movable slug received within the print wheels and having a home position wherein a portion extends intermediate the print wheels and the platen, means for moving said slug from said home position to a point wherein said portion is located between the print wheels upon the print switch sensing a document and means for returning the slug to its home position after the platen has printingly engaged to print wheels.

9. The obstruction means of claim 8 including solenoid means located within the machine and means connected to the slug and the solenoid for moving the slug upon the solenoid being actuated.

10. The obstruction mechanism of claim 9 wherein said moving means includes a lever pivotably mounted in said machine, a rod connected at one of its ends to said lever and at the other of its ends to said solenoid means, a pivotal connection means between said lever and said slug whereby upon said solenoid means being actuated said lever will be pivoted to cause said slug to be moved.

* * * * *